US009078482B2

(12) United States Patent
Weissner

(10) Patent No.: US 9,078,482 B2
(45) Date of Patent: Jul. 14, 2015

(54) SOUND PERMEABLE WIND NOISE REDUCTION DEVICE

(71) Applicant: Richard Allen Weissner, Boulder, CO (US)

(72) Inventor: Richard Allen Weissner, Boulder, CO (US)

( * ) Notice: Subject to any disclaimer, the term of this patent is extended or adjusted under 35 U.S.C. 154(b) by 125 days.

(21) Appl. No.: 14/040,718

(22) Filed: Sep. 29, 2013

(65) Prior Publication Data

US 2015/0090522 A1 Apr. 2, 2015

(51) Int. Cl.

| | |
|---|---|
| ***H04R 25/00*** | (2006.01) |
| ***A42B 3/04*** | (2006.01) |
| ***A42B 3/08*** | (2006.01) |

(52) U.S. Cl.

CPC ..... *A42B 3/0493* (2013.01); *A42B 3/08* (2013.01)

(58) Field of Classification Search

CPC ..... A61F 11/008; H04R 25/00
USPC ..... 181/136
See application file for complete search history.

(56) References Cited

U.S. PATENT DOCUMENTS

| | | | | | |
|---|---|---|---|---|---|
| 389,735 | A * | 9/1888 | Britton | 2/209 |
| 1,845,205 | A * | 2/1932 | Smith | 2/174 |
| 4,670,911 | A * | 6/1987 | Dunford | 2/209 |
| 4,682,374 | A * | 7/1987 | Geiser | 2/209 |
| 5,086,789 | A * | 2/1992 | Tichy | 128/866 |
| 5,477,564 | A * | 12/1995 | Tichy | 2/423 |
| 5,661,270 | A * | 8/1997 | Bozorgi-Ram | 181/129 |
| 6,029,282 | A * | 2/2000 | Buschman | 2/422 |
| 6,029,769 | A * | 2/2000 | Tichy | 181/136 |
| 6,220,386 | B1 * | 4/2001 | Tichy | 181/136 |
| 6,286,149 | B1 * | 9/2001 | Whitaker | 2/209 |
| 6,325,173 | B1 * | 12/2001 | Miller | 181/136 |
| 8,973,172 | B2 * | 3/2015 | Daniel | 2/423 |

* cited by examiner

*Primary Examiner* — Forrest M Phillips

(57) ABSTRACT

A wind absorbing and deflecting device attached to the leading strap on a cycling helmet to reduce wind noise while ambient sound passes through to the inner ear so that the user's hearing in not impaired. The device is located in front of the user's ear and against the temple. It is fabricated from faux fur with a pile length of approximately ½ inch and/or soft fleece with a thickness of ¼ to ½ inches. While cycling, the device deflects oncoming wind while the soft fleece and/or faux fur absorbs variable wind gusts and turbulence. The direct wind flow over the ear and particularly over the ear canal is significantly reduced so there is less air pressure variation and less wind noise.

14 Claims, 10 Drawing Sheets

*Sound Permeable Wind Noise Reduction Device A*

Sound Permeable Wind Noise Reduction Device A

Sound Permeable Wind Noise Reduction Device A

Sound Permeable Wind Noise Reduction Device B

Sound Permeable Wind Noise Reduction Device B

Sound Permeable Wind Noise Reduction Device C

Sound Permeable Wind Noise Reduction Device C

Sound Permeable Wind Noise Reduction Device D

Sound Permeable Wind Noise Reduction Device D

Sound Permeable Wind Noise Reduction Device E

Sound Permeable Wind Noise Reduction Device E

SOUND PERMEABLE WIND NOISE REDUCTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention relates generally to wind deflection. More particularly, it concerns a device for smoothly redirecting wind away from the ear for the purpose of decreasing any personally heard wind noise generated by air flow past the ear and head due to changes in air pressure, while at the same time permitting ambient sound to pass through untenanted. There are two main sources of perceived wind noise. In a head wind the first source is due to the shape of the head causing turbulence just behind the cheek bone, and has a spectral content that is heavily tilted toward lower frequencies. The second source appears to be due to stream flow by the concha which is the shallow cavity inside the ear just adjacent to the sensitive ear canal, and is apparently responsible for the higher frequency noise.

At low wind speeds, the combined noise spectrum creates a personal rumbling in the ear canal which gets louder and also higher in frequency as the wind speed increases. Unweighted measurements have been made of the noise created in the concha by the use of a microphone probe apparatus. See, U. R. Kristiansen, O. K. Pettersen 1978 Journal of Sound and Vibration, "Experiments On The Noise Heard By Human Beings When Exposed To Atmospheric Winds". For an average person facing a 21 mile per hour (mph) wind the noise spectrum was found to extend below 25 cycles per second (Hz) to about 150 Hz at an intensity of 92 decibels (db) above quiet hearing threshold. Prolonged exposure above 85 (dbA) causes slight hearing loss and hearing protection is recommended. The signal to noise ratio of speech to wind induced ear canal noise can significantly deteriorate for winds above 20 mph. This comes as no surprise to hard of hearing sufferers who have lost their high frequency sensitivity and must completely rely on the lower part of hearing spectrum. In this regard for many people with hearing loss, the tolerance for loud sound is lower than the tolerance of someone with normal hearing. Bike riders, skiers, etc. with good hearing may have considerable difficulty hearing ambient sounds such as traffic, conversations between companions, safety warnings and certain sounds of nature. High relative wind speeds are not uncommon, e.g., by cycling 15 mph into a 15 mph atmospheric wind the relative headwind is 30 mph.

There is the additional problem of fatigue. The apparent intensity of the wind seems to be greater when it can be heard. Constant and especially gusty wind noise over a long period of time can create considerable fatigue, which if not corrected can reduce the enjoyment of an activity and can turn to irritation. Worse, fatigue can also be a contributing factor in creating misjudgments and accidents.

BRIEF SUMMARY OF THE INVENTION

The invention is a wind deflector designed to offer no significant resistance to ambient sound but to facilitate an aerodynamic surface by which wind can be noiselessly bypassed along the side of the head and in particular the ear. The wind deflector is constructed of sound permeable fleece and/or wind impermeable, aerodynamically smooth, sound permeable fur. The fur itself contributes no noise as it absorbs wind turbulence energy. The wind deflector is secured to the leading strap of a cycling (or similar) helmet at the front of the ear to deflect wind turbulence past the ear.

DETAILED DESCRIPTION OF THE INVENTION

Figure 2:
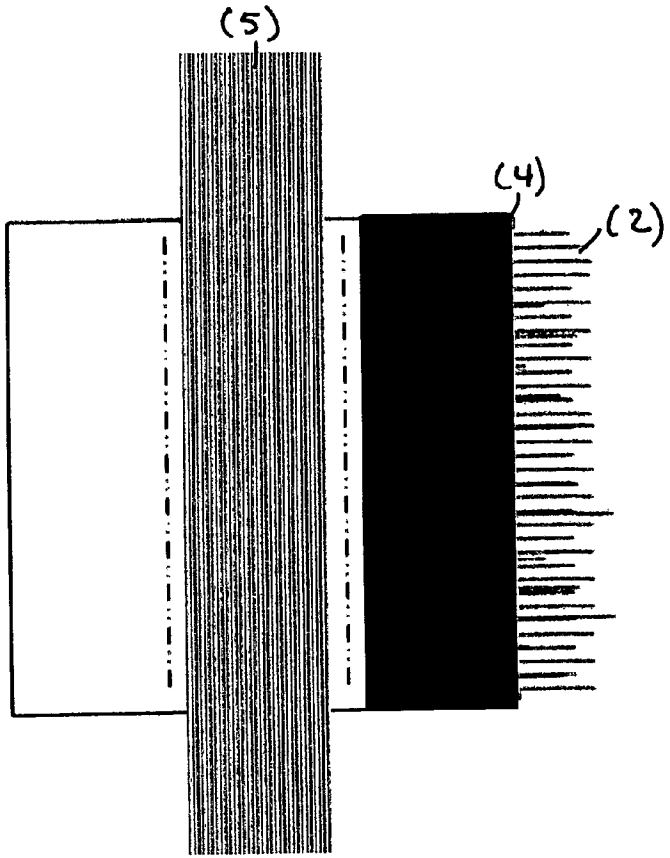
FIG. 2 illustrates the inner portion of Sound Permeable Wind Noise Reduction Device A
Figure 1:
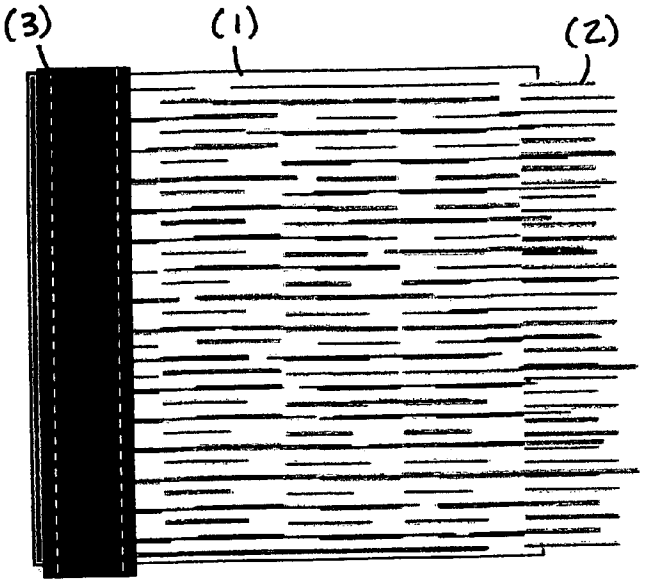
FIG. 1 illustrates the outer portion of Sound Permeable Wind Noise Reduction Device A
Figure 3:
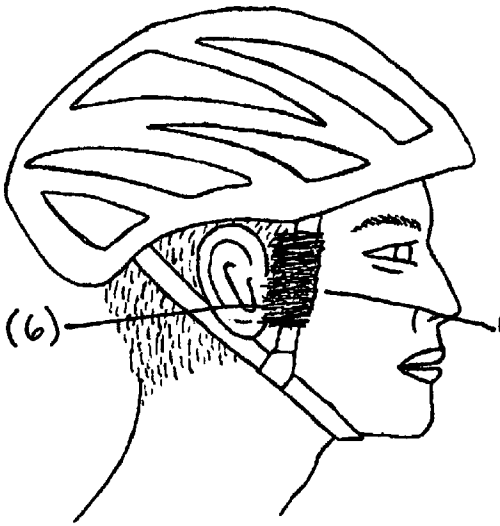
FIG. 3 illustrates side view of Sound Permeable Wind Noise Reduction Device A in use
Figure 4:
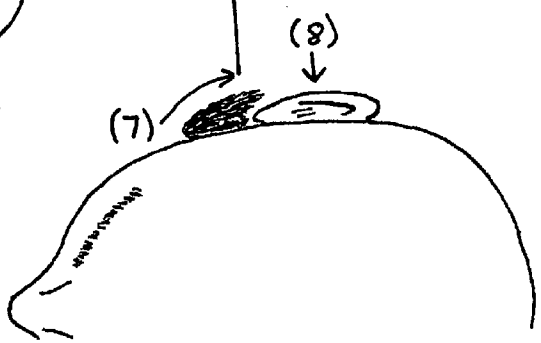
FIG. 4 illustrates top view of Sound Permeable Wind Noise Reduction Device A in use
Figure 5:
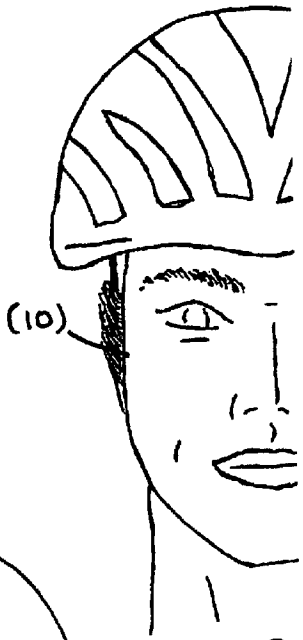
FIG. 5 illustrates front view of Sound Permeable Wind Noise Reduction Device A in use

Sound Permeable Wind Noise Reduction Device A is made of a 2½×2½ piece of faux fur with a pile length of approximately ½ inch and a moderate to heavy pile weight (>20) to maintain performance longevity FIG. 1(1) with a ½ inch rearward facing fur overhang FIG. 1(2). A hook fastener element strip is stitched onto the front edge of the fur FIG. 1(3) and a loop fastener element strip is adhered onto the back side of the faux fur material at the fur overhang FIG. 2(4) using a heat press allowing the device to be secured to the lead strap of a cycling (or similar) helmet. Device A is wrapped around the helmet strap FIG. 2(5) so that the fur overhand is rearward facing FIG. 3 (6). It is secured with the hook and loop fastener element. Wind is absorbed by the fur and deflected away from and around the ear as air passes from front to rear alongside the user's head FIG. 4(7). FIG. 4 illustrates how the device is curved with an appropriate aerodynamic shape to better deflect air around the ear. The ear is not covered by the device allowing ambient sounds to be heard FIG. 4(8). Device A placement is in front of the ear FIGS. 3 and 4(9) and the inner portion of the device rests against the user's face closing the gap between the helmet strap and face blocking wind turbulence from flowing between the strap and face FIG. 5 (10). FIGS. 3 and 5 show the device attached to the helmet strap holding the device firmly in place. When in place, the device measures 1½ inches in width and 2½ inches in length.

Figure 7:
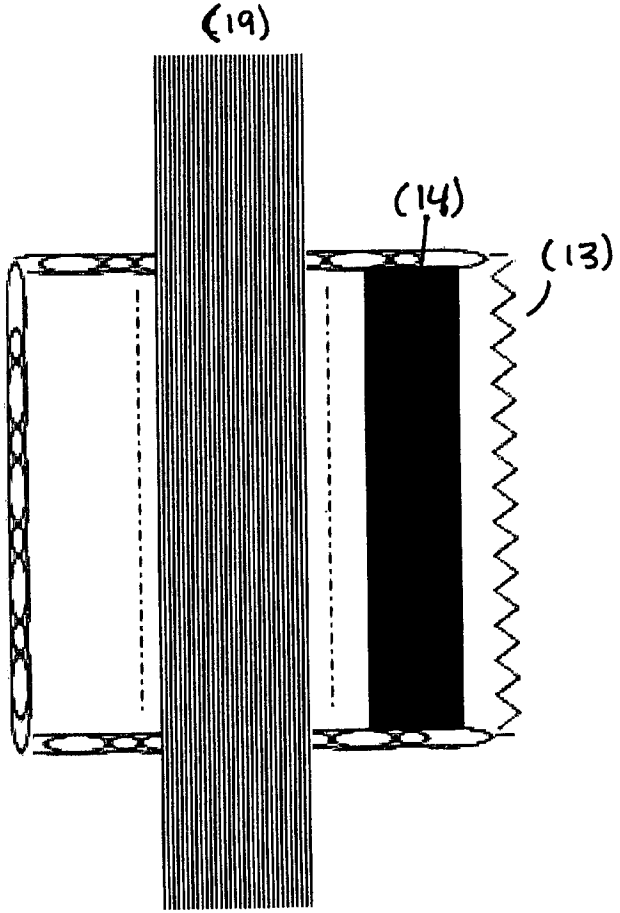
FIG. 7 illustrates the inner portion of Sound Permeable Wind Noise Reduction Device B

Sound Permeable Wind Noise Reduction Device B is similar to Device A but incorporates fleece material. Device B is made of a 2½×3 inch medium density fleece material with finished edges stitched with a Juki surging machine FIG. 6(11). The rearward facing edge of the fleece material is cut in a small zig zag shape creating added flexibility in the fleece fabric to allow wind to be absorbed and deflected away from the ear FIG. 6(12) and FIG. 7(13). A hook fastener element strip is adhered onto the back side of the fleece material at the zig zag FIG. 7(14) and a loop fastener element is adhered to the front side of the fleece material FIG. 6(15) using a heat press.

Figure 6:
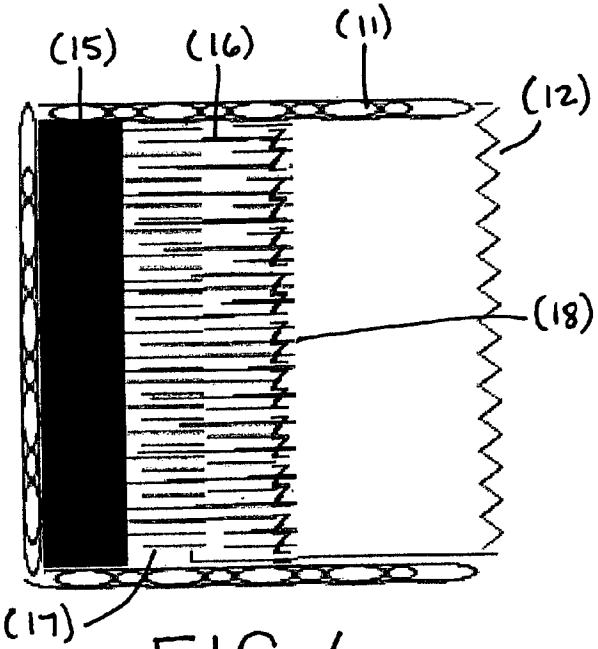
FIG. 6 illustrates the outer portion of Sound Permeable Wind Noise Reduction Device B
Figures 8, 9, 10:
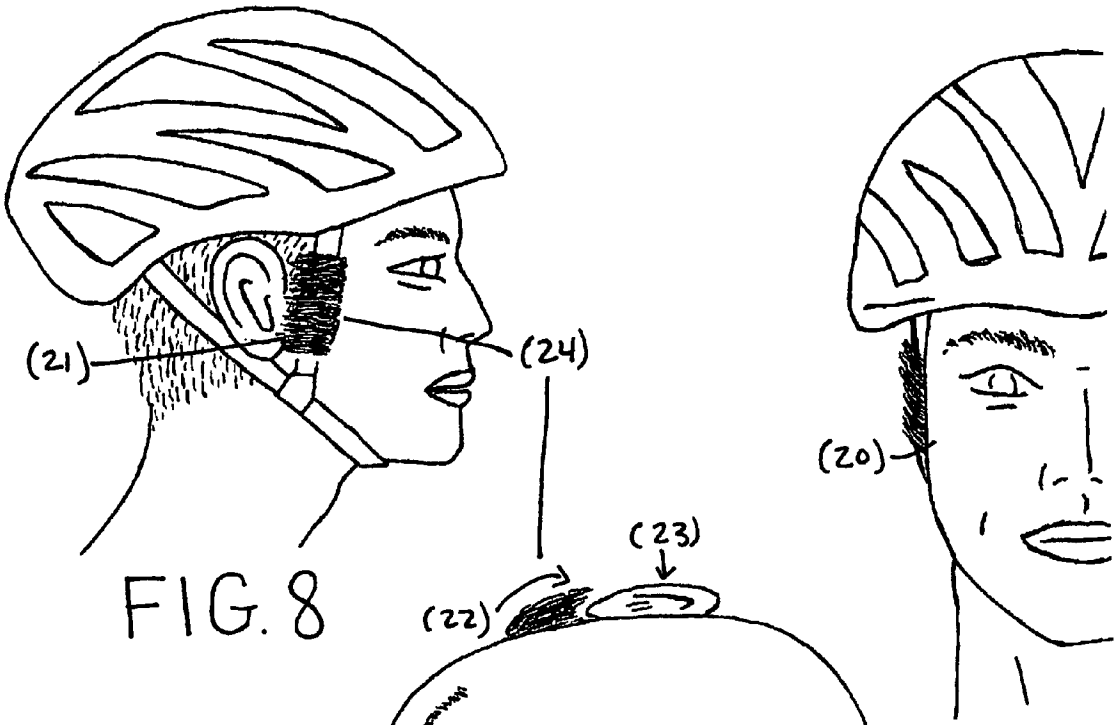
FIG. 8 illustrates side view of Sound Permeable Wind Noise Reduction Device B in use
FIG. 9 illustrates top view of Sound Permeable Wind Noise Reduction Device B in use
FIG. 10 illustrates front view of Sound Permeable Wind Noise Reduction Device B in use

A 2½×1⅝ inch piece of faux fur material with a pile length of approximately ½ inch and a moderate to heavy pile weight (>20) to maintain performance longevity FIG. 6 (16) with a ½ inch rearward facing fur overhang FIG. 6(17) is stitched onto the center of the fleece at the forward facing edge of the fur FIG. 6(18). The fur is then glued onto the fleece leaving approximately ¼inch exposed allowing for the fur overhang to properly lay in a rearward facing fashion. Device B is wrapped around the helmet strap FIG. 7(19) so that the fleece is on the inside of the strap next to the user's face FIG. 10(20) and the fur is on the outside of the helmet strap so that the fur overhang is rearward facing FIG. 8(21). Device B is secured with the hook and loop fastener element. Wind is absorbed by the fur and deflected away from and around the ear as air passes from front to rear alongside the user's head FIG. 9(22). FIG. 9 illustrates how the device is curved with an appropriate aerodynamic shape to better deflect air around the ear. The ear is not covered by the device allowing ambient sounds to be heard FIG. 8(23). Device B placement is in front of the ear FIGS. 8 and 9(24) and the inner fleece portion of the device rests against the user's face closing the gap between the helmet strap and face blocking wind turbulence from flowing between the strap and face FIG. 10(20). FIGS. 8 and 10 show the device attached to the helmet strap holding the device firmly in place. When in place the device measures 1% inches in width and 2½ inches in length.

Figures 11, 12, 13:
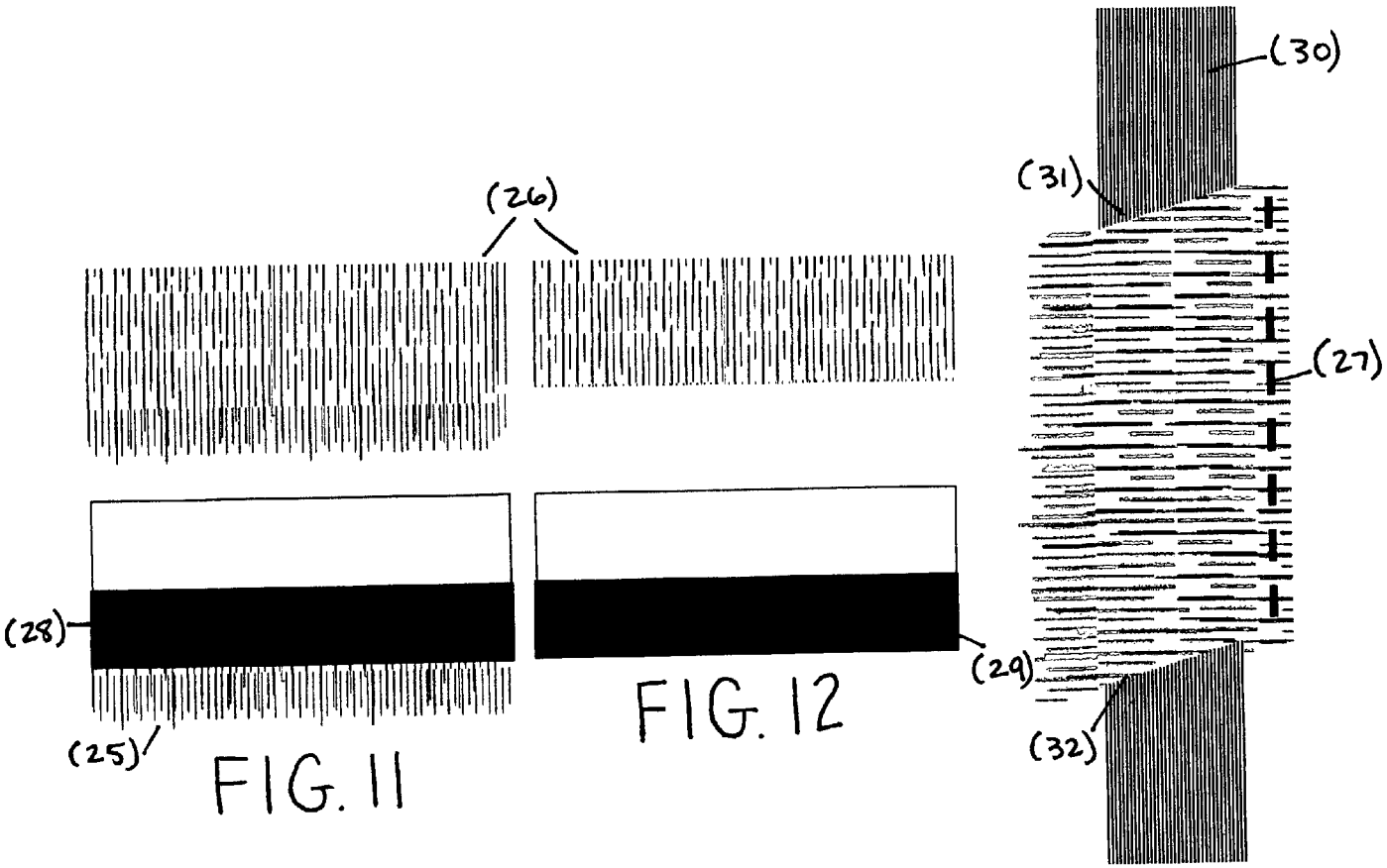
FIG. 11 illustrates outer portion of Sound Permeable Wind Noise Reduction Device C
FIG. 12 illustrates inner portion of Sound Permeable Wind Noise Reduction Device C
FIG. 13 illustrates side view of Sound Permeable Wind Noise Reduction Device C
Figures 14, 15, 16:
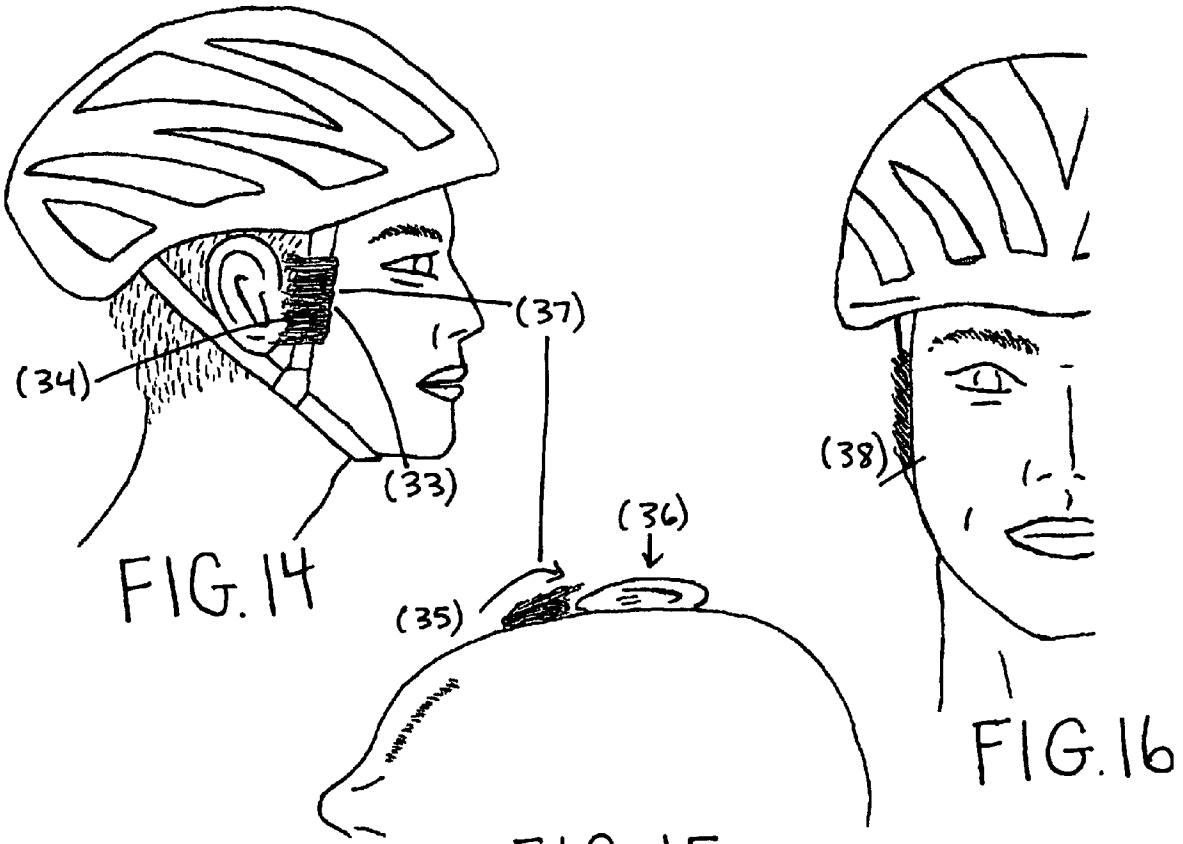
FIG. 14 illustrates side view of Sound Permeable Wind Noise Reduction Device C in use
FIG. 15 illustrates top view of Sound Permeable Wind Noise Reduction Device C in use
FIG. 16 illustrates front view of Sound Permeable Wind Noise Reduction Device C in use

Sound permeable Wind Noise Reduction Device C is similar to Device A but reduced in size for aesthetic purposes. Device C is made of a 1⅝ inch faux fur material with a pile length of approximately % inch and a moderate to heavy pile weight (>20) to maintain performance longevity FIG. 11 with a ½ inch fur overhang on the outer portion FIG. 11(25) and a 1⅛ inch faux fur material on the inner portion FIG. 12. The outer and inner portions are double stitched together using a zig zag stitch on the forward edge of each portion FIGS. 11 and 12 (26) and FIG. 13(27). A hook fastener element is adhered to the inside of the outer portion FIG. 11(28) and a loop fastener element is adhered to the inside of the inner portion FIG. 12(29) using a heat press allowing the device to be secured to the lead strap FIG. 13(30) of a cycling (or similar) helmet. The outer and inner portions are then cut at a 25 degree angle FIGS. 13(31 and 32). The device is positioned on the strap with the stitch edge facing forward FIG. 14(33) and secured using the hook and loop fastener element. The fur overhang on the outer portion should be rearward facing FIG. 14(34). Wind is absorbed by the fur and deflected away from and around the ear as air passes from front to rear alongside the user's head FIG. 15(35). FIG. 15 illustrates how the device is curved with an appropriate aerodynamic shape to better deflect air around the ear. The ear is not covered by the device allowing ambient sounds to be heard FIG. 15(36). Device C placement is in front of the ear FIGS. 14 and 15(37) and the inner portion of the device rests against the user's face closing the gap between the helmet strap and face blocking wind turbulence from flowing between the strap and face FIG. 16 (38). FIGS. 14 and 16 show the device attached to the helmet strap holding the device firmly in place. When in place the device measures 1½ inches in width and 2 inches in length.

Figure 18:
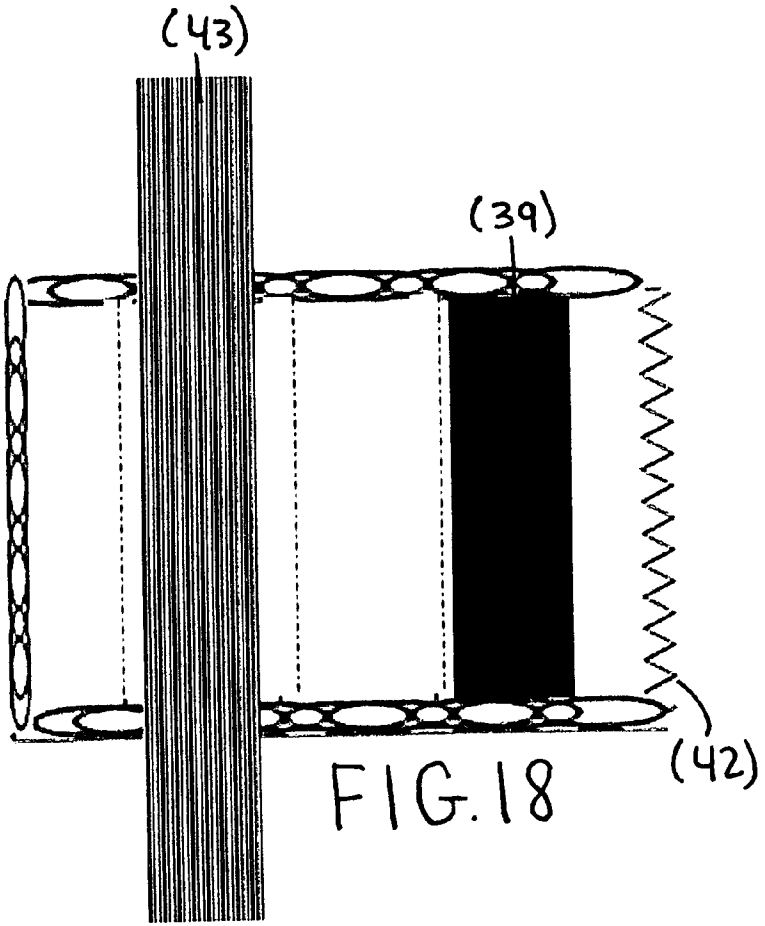
FIG. 18 illustrates inner portion of Sound Permeable Wind Noise Reduction Device D
Figure 17:
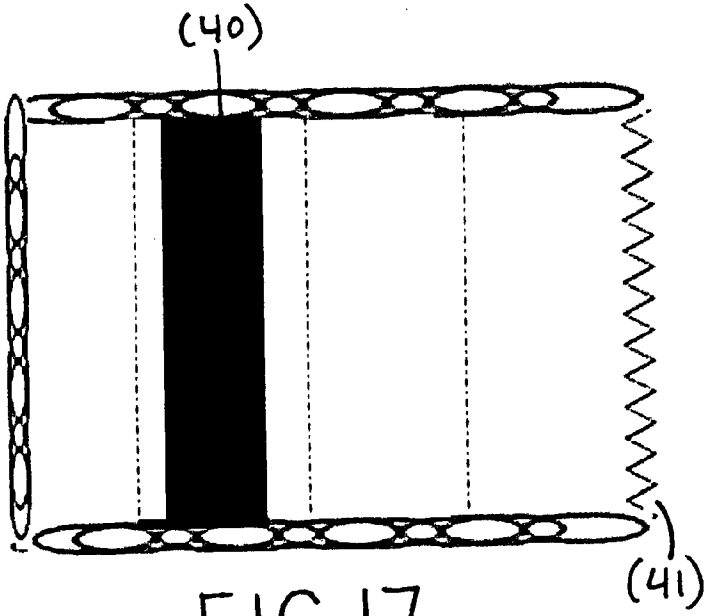
FIG. 17 illustrates outer portion of Sound Permeable Wind Noise Reduction Device D
Figures 19, 20, 21:
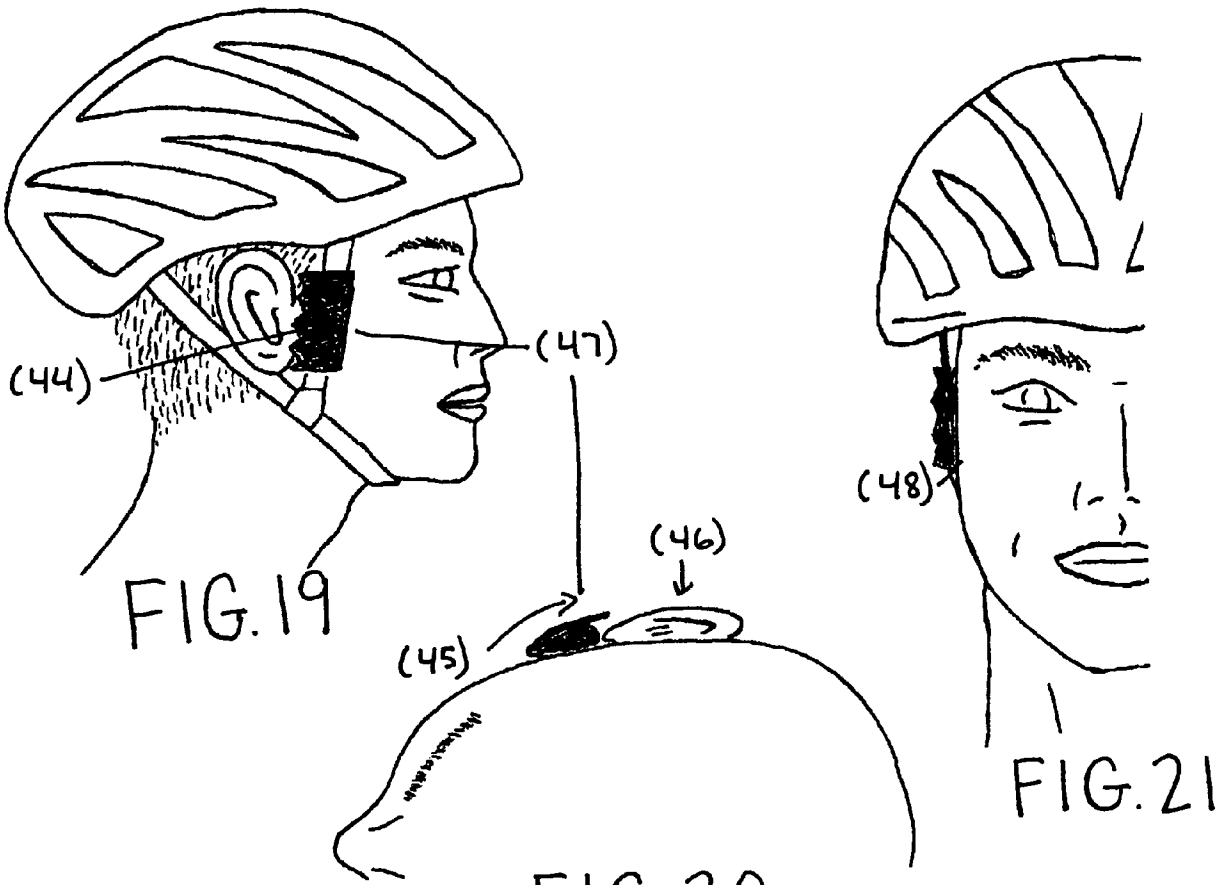
FIG. 19 illustrates side view of Sound Permeable Wind Noise Reduction Device D in use
FIG. 20 illustrates top view of Sound Permeable Wind Noise Reduction Device D in use
FIG. 21 illustrates front view of Sound Permeable Wind Noise Reduction Device D in use

Sound Permeable Wind Noise Reduction Device D is similar to Device B but does not incorporate fur. Device D is made of a 4×3 inch medium density fleece material with finished edges stitched with a Juki surger machine FIGS. 17 and 18. A hook fastener element strip is adhered onto the outer portion of the fleece material FIG. 18 (39) and a loop fastener element is adhered to the inner portion of the fleece material FIG. 17(40) using a heat press. The rearward facing edge of the fleece material is cut in a small zig zag shape creating added flexibility in the fleece fabric to allow wind to be absorbed and deflected away from and around the ear FIG. 17(41) and FIG. 18(42). Device D is wrapped twice around the helmet strap FIG. 18(43) creating a thicker outward wind deflection FIG. 21(48) so that the zig zag shaped edge is rearward facing on the outside of the helmet strap FIG. 19(44) for wind deflection past the ear as air passes from front to rear alongside the user's head FIG. 20(45). FIG. 20 illustrates how the device is curved with an appropriate aerodynamic shape to batter deflect air around the ear. The ear is not covered by the device allowing ambient sounds to be heard FIG. 20(46). Device D placement is in front of the ear FIGS. 19 and 20(47) and the inner fleece portion of the device rests against the user's face closing the gap between the helmet strap and face blocking wind turbulence from flowing between the strap and face FIG. 21 (48). FIGS. 19 and 21 show the device attached to the helmet strap holding the device firmly in place. When in place the device measures 1 inch in width and 3¾ inches in length.

Figure 23:
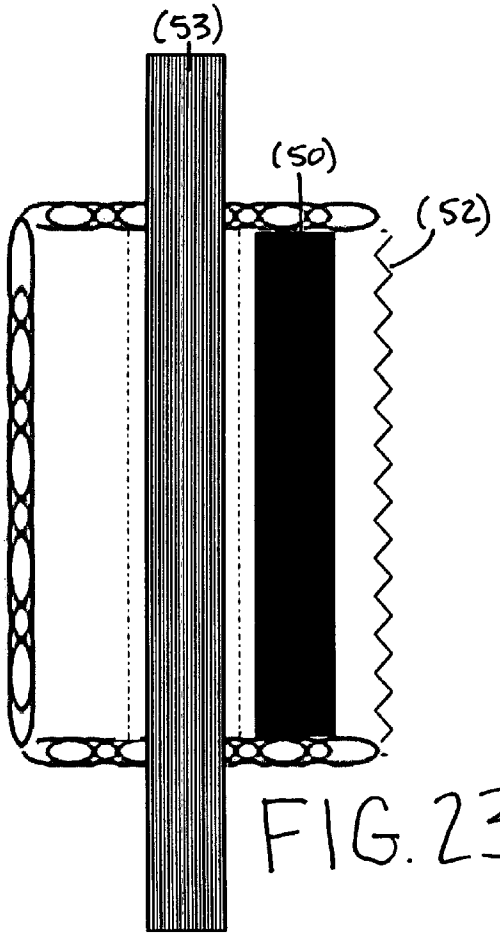
FIG. 23 illustrates inner portion of Sound Permeable Wind Noise Reduction Device E
Figure 22:
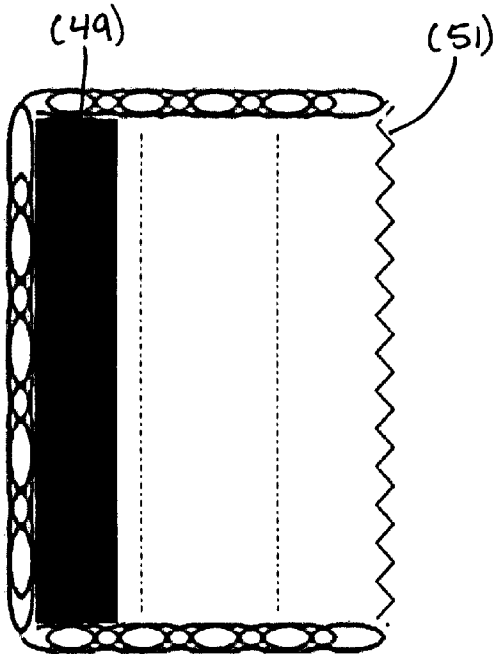
FIG. 22 illustrates outer portion of Sound Permeable Wind Noise Reduction Device E
Figures 24, 25, 26:
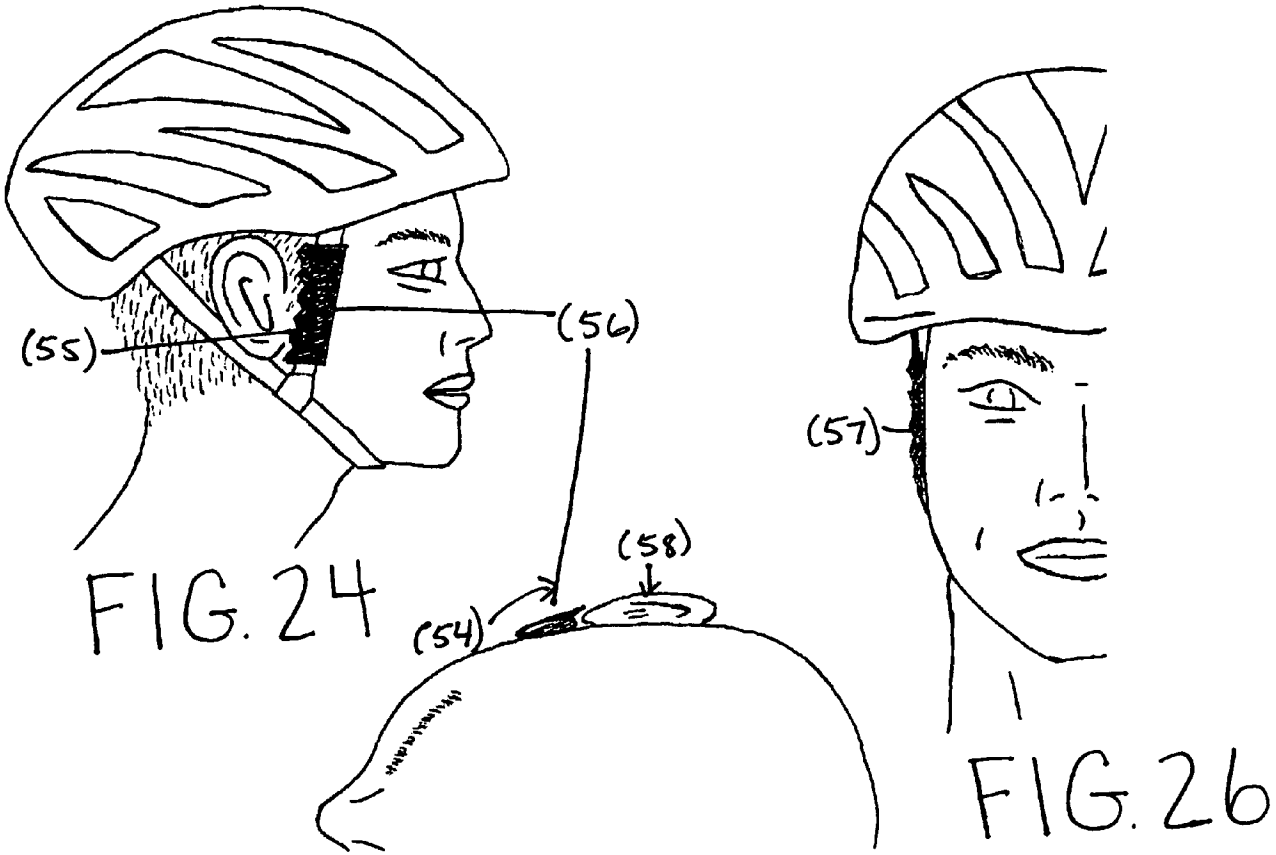
FIG. 24 illustrates side view of Sound Permeable Wind Noise Reduction Device E in use
FIG. 25 illustrates top view of Sound Permeable Wind Noise Reduction Device E in use
FIG. 26 illustrates front view of Sound Permeable Wind Noise Reduction Device E in use

Sound Permeable Wind Noise Reduction Device E is similar to Device D. Its length is increased to cover the length of the helmet strap along the face reducing both wind and strap noise and increase strap comfort. Device E is made of a 2¾×3½ inch medium density fleece material with finished edges stitched with a Juki surger machine FIG. 22 and FIG. 23. A hook fastener element strip is adhered onto the inner portion of the fleece material FIG. 22(49) and a loop fastener element is adhered to the outer portion of the fleece material FIG. 23(50) using a heat press. The rearward facing edge of the fleece material is cut in a small zig zag shape FIG. 22(51) and FIG. 23(52) creating added flexibility in the fleece fabric to allow wind to be absorbed and deflected away from and around the ear FIG. 25(54). Device E is wrapped around the helmet strap FIG. 23(53) and the zig zag shaped edge is rearward facing on the outside of the helmet strap FIG. 24(55) for wind deflection past the ear as air passes from front to rear alongside the user's head FIG. 25(54). Device E placement is in front of the ear FIGS. 24 and 25(56) and the inner fleece portion of the device rests against the user's face closing the gap between the helmet strap and face blocking wind turbulence from flowing between the strap and face FIG. 26 (57). FIG. 25 illustrates how the device is curved with a appropriate aerodynamic shape to better deflect air around the ear. The ear is not covered by the device allowing ambient sounds to be heard FIG. 25(58). FIGS. 24 and 26 show the device attached to the helmet strap holding the device firmly in place. When in place the device measures 1½ inches in width and 2 inches in length.

Sound Permeable Wind Noise Reduction Devices A through E differ from others in that they are constructed from soft wind absorbing rearward facing material versus harder sound blocking materials. They are uniquely designed to both deflect oncoming wind and absorb variable (gusty) wind turbulence. This unique combination significantly reduces direct wind flow over and around the ear while allowing ambient sounds to pass through and be heard. Previous devices, including devices which may have incorporated fiber like materials, were designed to deflect and block air flow with forward or outward facing materials, or act like ear muffs. The ½ inch pile length of the fur and the rearward facing fur overhang create a more laminar air flow over and past the ear. Similarly the ½ inch rearward facing zig zag overhang of the fleece material creates a more laminar air flow over and past the ear. Our devices do not cover the ears so they do not reduce the ability to hear. Our devices also incorporate a barrier between the helmet strap and the face of the user blocking air flow between the two. Other devices do not address this. Additionally, our devices do not impact the ability to wear protective eyewear.

It is intended that all matter contained in the above description and shown in the accompanying drawings shall be interpreted as illustrative and not meant in a limited sense. Modification and variation can be made to the disclosed embodiments without departing from the subject of the invention as defined by the following claims.

The invention claimed is:

1. An apparatus worn on the lead strap of a sport helmet, which passes in front of the ear, for reducing noise caused by wind flowing past the user's ear, the apparatus comprising:

A wind deflector including,

A sound permeable outer portion of fleece or fur configured to partially cover the front part of the ear, said outer portion shaped such that wind flows smoothly over the outer surface and past the ear;

A sound permeable inner portion of fleece or fur attached to the outer portion located alongside the user's face about the ear, said inner portion having a smooth surface flush with the outer surface, closing the gap between the helmet strap and the user's face;

A sound permeable outer portion sized to cover the front portion of the ears, leaving the inner and rear portion of the ear exposed to allow ambient sound to be heard; and Securing means, located on the outer and inner portion, for securing said wind deflector to the sport helmet strap.

2. The apparatus according to claim 1, wherein said securing means further comprises hook and loop fasteners.

3. The apparatus of claim 1 wherein said outer and inner portions are secured around the sport helmet strap stabilizing said strap to reduce ear wind noise passing through the helmet strap to the ear.

4. The apparatus of claim 1 wherein said outer portion includes rearward facing fur shaped to dampen, buffer and deflect wind around the user's ear.

5. The apparatus of claim 1 wherein said inner portion includes a fleece material.

6. The apparatus of claim 1 wherein said outer portion has a slightly curved wing shape surface.

7. The apparatus of claim 1 where in said outer portion extends slightly outward of the ear to deflect wind around the user's ear.

8. The apparatus of claim 1 wherein said inner portion has a substantially flat inner surface which contacts the face about the ear of the user.

9. The apparatus of claim 1 wherein hook and loop faster elements are attached to secure said apparatus to the user's helmet strap.

10. The apparatus of claim 1 wherein the inner portion of the apparatus creates a barrier between the helmet strap and the face blocking wind from flowing between the helmet strap and the face.

11. The apparatus of claim 1 wherein the inner portion of the apparatus creates increased strap comfort.

12. The apparatus of claim 1 wherein the fleece material of the apparatus creates increased strap comfort.

13. The apparatus of claim 1 wherein the inner portion of the apparatus creates a barrier between the helmet strap and the face blocking wind from flowing between the helmet strap and the face.

14. The apparatus of claim 1 wherein the inner portion of the apparatus creates increased strap comfort.

* * * * *